US005813141A

United States Patent [19]

Cho

[11] Patent Number: 5,813,141

[45] Date of Patent: Sep. 29, 1998

[54] CUSHIONING SOLE FOR FOOTWEAR

[76] Inventor: Woo Joo Cho, 707 Onchun-2 Dong, Lucky Apt. 10-1102, Dongre-Ku, Pusan, Rep. of Korea

[21] Appl. No.: 839,321

[22] Filed: Apr. 17, 1997

[51] Int. Cl.[6] ..... A43B 13/20

[52] U.S. Cl. ..... 36/29; 36/141

[58] Field of Search ..... 36/28, 29, 3 B, 36/141

[56] References Cited

U.S. PATENT DOCUMENTS

| | | | |
|---|---|---|---|
| 3,253,355 | 5/1966 | Medrano | 36/29 |
| 3,716,930 | 2/1973 | Menken | 36/3 B |
| 4,336,661 | 6/1982 | Brahm | 36/3 B X |
| 4,635,384 | 1/1987 | Huh et al. | 36/29 X |
| 5,220,737 | 6/1993 | Edington | 36/29 X |
| 5,295,314 | 3/1994 | Moumdjian | 36/29 X |
| 5,444,926 | 8/1995 | Allen et al. | 36/29 X |

*Primary Examiner*—Ted Kavanaugh

*Attorney, Agent, or Firm*—Birch, Stewart, Kolasch & Birch, LLP

[57] ABSTRACT

A cushioning sole for footwear, which includes an air bag containing air and sponge plates and disposed within an outer sole, and midsole for enclosing the outer sole of a shoe such as sport shoes, working shoes, boots, and the like, whereby when the footwear user walks, runs, or jumps, shock from the ground to the human body can be effectively eliminated and reduced, and the footwear user can stably straighten oneself in walking posture.

5 Claims, 2 Drawing Sheets

CUSHIONING SOLE FOR FOOTWEAR

BACKGROUND OF THE INVENTION

1. Field of the Invention

The present invention relates to an improved sole for footwear and more particularly, to an air bag containing air and sponge plates and disposed within an outer sole, and a midsole for enclosing the outer sole of a shoe such as sport shoes, working shoes, boots, and the like, for reducing shock to the human body, providing cushioning and massaging functions and facilitating a stable walk posture when the footwear wearer utilizes the shoe.

2. Description of Related Art

Presently known footwear soles comprise elastomeric pads which are made of soft materials such as sponge or rubber. Also, various types of soles containing separate air bags disposed therein are known in the art. These types of soles include pockets for storing separate air bags. However, such soles have to have a substantial thickness to accommodate the thickness of the original middle sole plus the thickness of the air bag, so that these types of soles are not effective in eliminating shock or impact during walking, running, and jumping.

Also, various types of footwear having a sole with a ventilation system are also known in the art. However, such conventional soles having a ventilation system suffer from a number of problems, such as for example, they are complicated in structure, so that the soles readily become nonfunctional in reducing shock to the human body during walking, running, and jumping.

SUMMARY OF THE INVENTION

Accordingly, it is an object of the present invention to provide a cushioning sole for footwear which eliminates the above problems encountered in conventional air insoles.

Another object of the present invention is to provide a footwear sole which includes an entire air bag containing air openings and sponge plates and disposed between an outer sole and a midsole for enclosing the outer sole of a shoe, such as sport shoes, working shoes, boots, and the like for reducing shock to the human body and providing a cushioning function and facilitating a stable walk posture while walking, running, or jumping.

A further object of the present invention is to provide a cushioning sole for footwear, which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a cushioning sole for footwear, which includes an air bag containing air and sponge plates and disposed within an outer sole, and midsole for enclosing the outer sole of a shoe such as aport shoes, working shoes, boots, and the like, whereby when the footwear user walks, runs, or jumps, shock from the ground to the human body can be effectively eliminated and reduced, and the footwear user can stably straighten oneself in walking posture.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
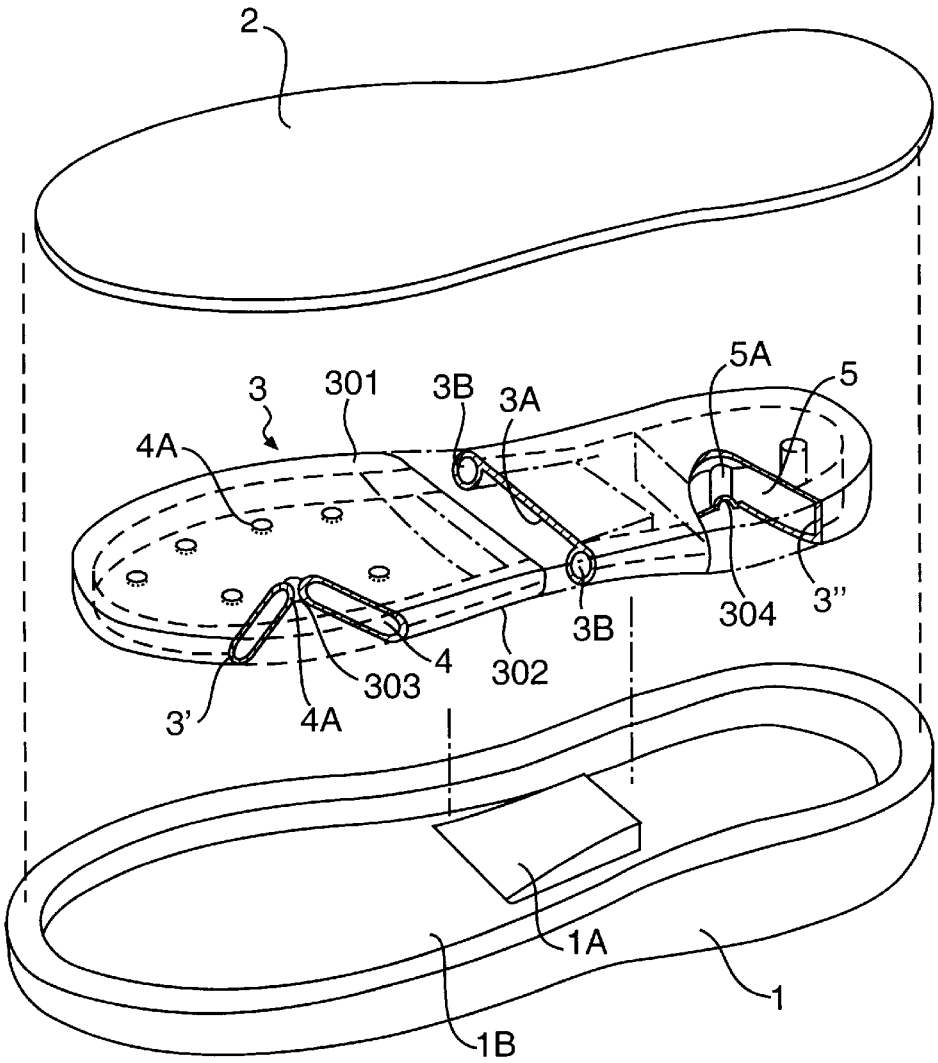
FIG. 1 is an exploded perspective view of the cushioning sole of the present invention showing in a cut-away portion thereof, the air bag disposed within the outer sole in order to illustrate the construction of the sole according to the present invention.
Figure 2:
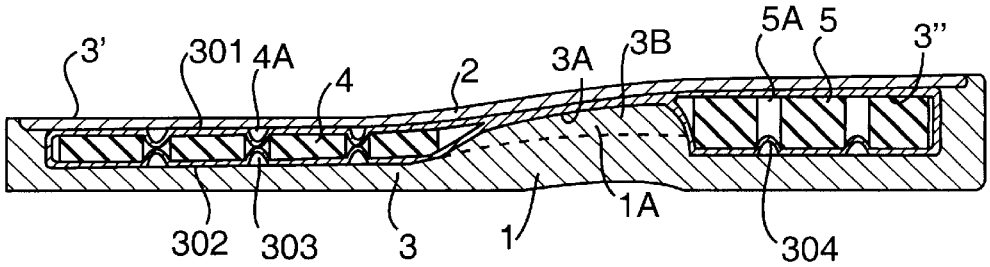
FIG. 2 is a sectional view of the assembled outer sole with the midsole of FIG. 1.
Figure 3:
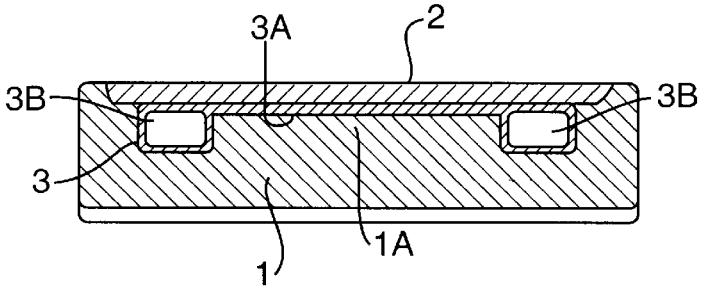
FIG. 3 is a cross-sectional view of the assembled outer sole with the insole of FIG. 1.

Referring now in detail to the drawings for the purpose of illustrating the preferred embodiments of the present invention, the pneumatic insole for footwear as shown in FIGS. 1, 2, and 3, comprises an outer sole 1 having a hollow inside 1B and a lug 1A disposed on a middle portion of the hollow inside 1B, an air bag 3 for enclosing inserting into the outer sole 1, a midsole 2 for covering the outer sole 1 after receiving the air bag 3.

The air bag 3 enclosed with a top cover 301 and a bottom cover 302 includes a rear chamber 3" disposed in a heel position and a front chamber 3' disposed in a front position of the outer sole 1. Also, the air bag 3 further includes a groove 3A disposed in a middle position of the outer sole 1 for tightly receiving the lug 1A, and a pair of channels 3B for communicating between the heel and front chambers 3" and 3' as shown in FIG. 3.

As shown in FIG. 2, the front chamber 3' contains a plurality of front sponge plates 4 wherein each front sponge plate 4 is enclosed with the top and bottom covers 301 and 302 by knotting each other, a plurality of front openings 4A disposed between the plurality of sponge plates 4, and a plurality of front profiles 303 disposed in the plurality of front openings 4A and produced by knotting the top cover 301 and the bottom cover 302. The rear chamber 3" contains a plurality of rear sponge plates 5, a plurality of rear openings 5A disposed between the plurality of rear sponge plates 5, and a plurality of rear profiles 304 disposed in the plurality of rear openings 5A and extended from the bottom cover 302.

Accordingly, the front and rear sponge plates 4 and 5 are protected from moving since the front sponge plates 4 are enclosed within a kind of capsule by knotting the top and bottom covers 301 and 302 and the rear sponge plates 5 are retained by the plurality of rear profiles 304. And the plurality of openings 4A and 5A, of sponge plates 4 and 5, and of profiles 303 and 304, provide cushioning and massaging functions. The air bag 3 is made of soft synthetic resin and the front and rear sponge plates 4 and 5 are made of polyethylene sponge, ethylene-vinyl acetate copolymer sponge, or polyurethane sponge.

Figure 4A:
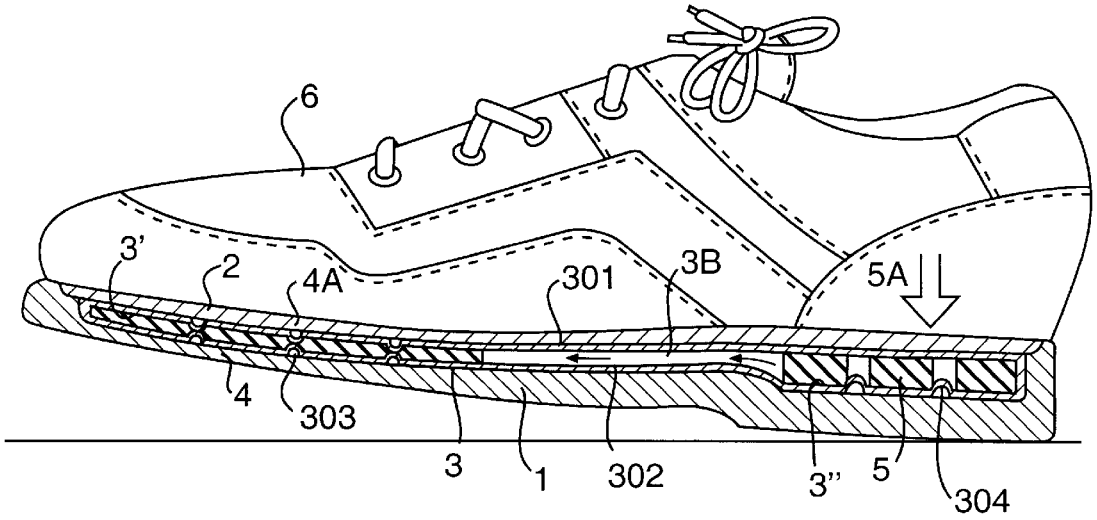
FIG. 4(A) is a side view of the footwear containing the cushioning sole according to the present invention shown when applied to the ground as a first step at a heel chamber portion and showing a cut-away portion thereof in order to illustrate the construction of the present invention.

The cushioning sole for footwear according to the present invention operates as follows. As shown in FIG. 4(A), when the wearer of the footwear 6 steps on a surface 12, e.g. the ground, the air in the rear chamber 3" pressed against the heel of the foot moves to the front chamber 3' for absorbing shock and impact from the human body. At this time, the air in the rear chamber moves to the pair of channels 3B. Thereafter, the air of the pair of channels 3B moves to the front chamber 3'. Also, simultaneously the plurality of rear profiles 304 and rear sponge plates 5 massage the foot and provide a cushioning effect to the wearer which reduces the amount of human body shock produced by walking, running, or jumping.

Figure 4B:
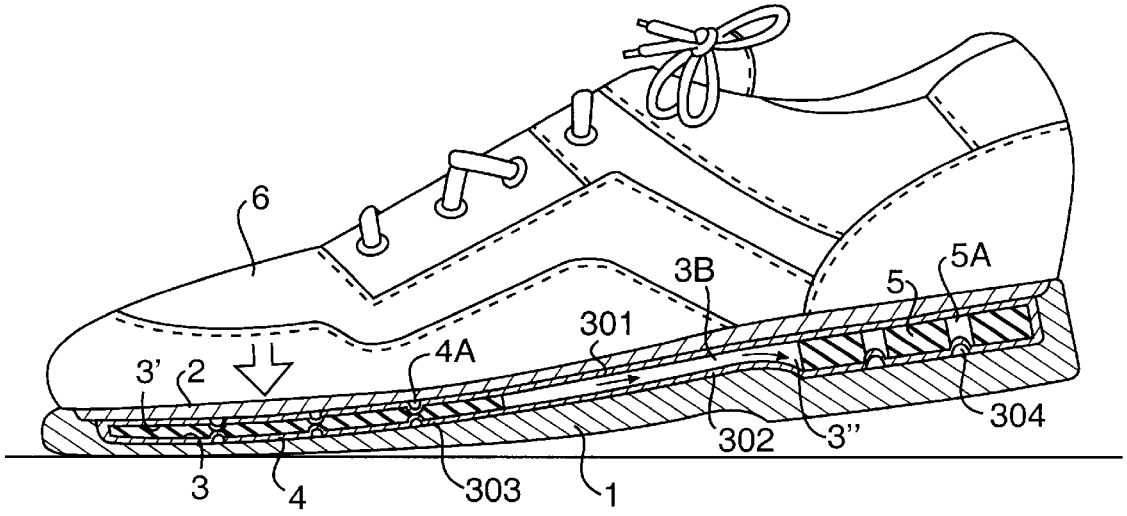
FIG. 4(B) is a side view of the footwear containing the cushioning sole according to the present invention shown when applied to the ground as a final step in a chamber portion and released from ground at the foot sole chamber portion, and showing a cut-away portion thereof in order to illustrate the construction of the present invention.

As shown in FIG. 4(B), when the wearer of the footwear 6 releases the foot from the surface 12, the compressed air in the front chamber 3' is pressed by the front position of the foot and moves to the rear chamber 3" for absorbing shock and impact from the human body and massages the wearer on the sole of the foot in the direction indicated by arrows shown in FIG. 4(B). At this time, the rear chamber 3" returns to its original form by the resilient force thereof. At this time, the air in the front chamber 3' passes through the pair of channels 3B to the rear chamber 3". Also, the front profiles 303, front sponge plates 4 and front openings 4A provide cushioning and massaging effect.

Accordingly, the cushioning sole for footwear according to the present invention is simple in structure, inexpensive and easy to manufacture, easy in use, attractive in appearance, and furthermore the cushioning sole has a multiplicity of functions such as, for example, absorption of shock and impact to the human body, and cushioning and massaging of the sole of the wearer's feet during walking, running, and jumping.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cushioning sole for footwear, comprising:

an outer sole having a hollow inside and a lug disposed on a middle portion of said hollow inside, an air bag enclosed with a top cover and a bottom cover, said air bag including:

a heel chamber containing a plurality of sponge plates, a plurality of rear openings disposed between said sponge plates, and a plurality of rear profiles extending from said bottom cover and disposed in said plurality of rear openings;

a pair of air passages and a hollow portion disposed in a middle portion thereof for tightly adhering with said lug;

a front chamber containing a plurality of sponge plates, a plurality of front openings disposed between said sponge plates, and a plurality of front profiles knotted from said top and bottom covers and disposed in the plurality of front openings; and a midsole secured to said outer sole containing said air bag, whereby when the wearer of the footwear steps on a surface and releases from the surface, the air moves between the heel and from chambers through a pair of air passageways so as to absorb shock and cushion impact and massage a sole of a foot.

2. The cushioning sole for footwear according to claim 1, wherein said plurality of front sponge plates includes four plates and said plurality of rear sponge plates includes three plates.

3. The cushioning sole for footwear according to claim 2, wherein said plurality of front openings includes six openings and said plurality of rear openings includes three openings.

4. The cushioning sole for footwear according to claim 3, wherein said front and rear profiles disposed in said front and rear openings and disposed in said front and heel chamber, respectively, retain and prevent the front and rear sponge plates from moving while providing cushioning and massaging functions.

5. The cushioning sole for footwear according to claim 1, wherein said front and rear sponge plates are made of a material selected from the group consisting of polyethylene sponge, ethylene-vinyl acetate copolymer sponge, and polyurethane sponge.

* * * * *

UNITED STATES PATENT AND TRADEMARK OFFICE

CERTIFICATE OF CORRECTION

PATENT NO. : 5,813,141

DATED : Sept. 29, 1998

INVENTOR(S) : Cho

It is certified that error appears in the above-indentified patent and that said Letters Patent is hereby corrected as shown below:

On the title page: Item "[76] Inventor:", please correct the spelling of the inventor's name from "Woo Joo Cho" to – Woo Joon Cho –.

Signed and Sealed this

Twelfth Day of October, 1999

*Attest:*

Q. TODD DICKINSON

*Attesting Officer*

*Acting Commissioner of Patents and Trademarks*